US008635983B2

(12) United States Patent
Enokida

(10) Patent No.: US 8,635,983 B2
(45) Date of Patent: Jan. 28, 2014

(54) OIL PAN STRUCTURE AND SEPARATOR FOR PARTITIONING OIL PAN

(75) Inventor: Satoshi Enokida, Hiroshima (JP)

(73) Assignee: DaikyoNishikawa Corporation, Aki-gun, Hiroshima (JP)

( * ) Notice: Subject to any disclaimer, the term of this patent is extended or adjusted under 35 U.S.C. 154(b) by 444 days.

(21) Appl. No.: 12/702,489

(22) Filed: Feb. 9, 2010

(65) Prior Publication Data

US 2010/0300395 A1 Dec. 2, 2010

(30) Foreign Application Priority Data

May 29, 2009 (JP) ..... 2009-131501
Jun. 8, 2009 (JP) ..... 2009-136868

(51) Int. Cl.
*F02B 75/22* (2006.01)

(52) U.S. Cl.
USPC ..... 123/195 R; 123/195 C; 123/195 AB; 184/6.13; 184/68; 184/80; 184/88.1; 184/104.1

(58) Field of Classification Search
USPC ..... 123/195 R, 195 C, 196 R, 196 CP, 123/196 AB, 195 E, 58.1, 195 H, 196 S; 184/106, 104.3, 104.2, 6, 13, 68, 80, 184/88.1, 104.1; 440/75, 111
See application file for complete search history.

(56) References Cited

U.S. PATENT DOCUMENTS

| | | | | |
|---|---|---|---|---|
| 5,937,817 | A * | 8/1999 | Schanz et al. | 123/196 AB |
| 7,350,497 | B2 * | 4/2008 | Hiraoka et al. | 123/196 R |
| 7,757,656 | B2 * | 7/2010 | Hoi et al. | 123/196 R |
| 2008/0078712 | A1 * | 4/2008 | Enokida et al. | 210/167.02 |

FOREIGN PATENT DOCUMENTS

| | | | |
|---|---|---|---|
| CN | 201083138 | Y | 7/2008 |
| JP | 2003-222012 | | 8/2003 |
| JP | 2005-325798 | | 11/2005 |
| JP | 2006-189002 | | 7/2006 |
| JP | 2006-275039 | | 10/2006 |
| JP | 2007-092574 | | 4/2007 |
| JP | 2008-297972 | | 12/2008 |
| JP | 2008297972 | A * | 12/2008 |

OTHER PUBLICATIONS

Machine Translation of JP2008297972A (PDF file: "JP2008297972A_Machine_Translation.pdf").*

* cited by examiner

*Primary Examiner* — Thanh Truong
*Assistant Examiner* — Ruben Picon-Feliciano
(74) *Attorney, Agent, or Firm* — Nixon Peabody LLP; Jeffrey L. Costellia

(57) ABSTRACT

An oil pan 1 includes: an oil pan body 2 having a reservoir 21 for storing oil circulated in an engine E and returned to the reservoir 21; and a separator 3 having a vertically extending sidewall unit 4 partitioning the reservoir 21 into a first reservoir 21*a* for storing high-temperature oil and a second reservoir 21*b* for storing low-temperature oil. The first reservoir 21*a* has a suction-member-placement region 22 in which a member for sucking oil is provided. The separator 3 has an inclined portion 61 extending, to the suction-member-placement region 22, from a portion below a downstream end of a return pipe Rt for allowing oil to return to the first reservoir 21*a*.

8 Claims, 10 Drawing Sheets

OIL PAN STRUCTURE AND SEPARATOR FOR PARTITIONING OIL PAN

BACKGROUND

The present disclosure relates to oil pan structures for storing oil circulated in power units in, for example, automobiles, and also relates to separators for partitioning oil pans.

Conventional power units include oil pans for storing oil in order to lubricate or cool parts of the power units. Oil stored in the oil pan is sucked by an oil pump through a strainer, circulates in parts of the power unit, and then returns to the oil pan.

Immediately after a cold start of a power unit, oil stored in an oil pan is cold, and therefore, has high viscosity, thereby reducing fuel efficiency. To prevent this, an oil pan described in Japanese Patent Publication No. 2008-297972 (hereinafter referred to as Patent Document 1) includes: an oil pan body having a reservoir for storing oil; and a separator disposed in the oil pan body. The separator partitions the reservoir into a first reservoir located inside the separator and a second reservoir located outside the separator. Immediately after a cold start, oil in the first reservoir is supplied to parts of a power unit through a strainer disposed in a lower portion of the first reservoir, circulates in the parts of the power unit, and then returns to the first reservoir. In this manner, oil in the first reservoir is continuously supplied to the parts of the power unit, thereby quickly increasing the temperature of oil circulating in the parts of the power unit.

SUMMARY

Immediately after a cold start of a power unit, the temperature of oil is low, and the viscosity of the oil is high. Accordingly, the power unit exhibits poor lubrication performance. In the oil pan of Patent Document 1, however, oil warmed after having circulated in the power unit returns to the reservoir from various portions of the oil pan body located above the reservoir. Before returning to the reservoir, the oil comes into contact with various portions of the separator. Accordingly, the area of oil in contact with the separator per a unit amount of oil is large, and thus oil warmed in the power unit is cooled before the oil reaches the strainer. Consequently, it takes time to start a continuous supply of oil with high lubrication performance to the power unit.

It is therefore an object of the present disclosure to provide an oil pan structure capable of continuously supplying oil with high lubrication performance to a power unit by reducing the contact area of oil returned from the power unit with a separator per a unit amount of oil. It is another object of the present disclosure to provide a separator for partitioning an oil pan.

SOLUTION TO THE PROBLEM

To achieve the above-mentioned object, in a first aspect of the present invention, an oil pan structure includes: an oil pan body including a reservoir configured to store oil circulated in a power unit and returned to the reservoir; and a separator including a vertically extending sidewall unit configured to partition the reservoir into a first reservoir and a second reservoir. In the oil pan structure, oil is allowed to flow between the first reservoir and the second reservoir, the first reservoir has a suction-member-placement region in which a member for sucking oil is provided, and the separator has an oil guide surface extending, to the suction-member-placement region, from a portion below a downstream end of an oil passageway configured to allow oil circulated in the power unit to return to the first reservoir.

In a second aspect of the present invention, in the oil pan structure of the first aspect, an oil receiver configured to receive oil below the downstream end of the oil passageway is provided on the oil guide surface, and the oil receiver is located on top of the oil guide surface.

In a third aspect of the present invention, the oil pan structure of the first or second aspect further includes: a communication portion configured to establish communication between the first reservoir and the second reservoir; and an opening/closing means configured to open the communication portion when a temperature of oil in the first reservoir is equal to or higher than a given temperature, and to close the communication portion when the temperature of oil in the first reservoir is lower than the given temperature.

In a fourth aspect of the present invention, in the oil pan structure of the first or second aspect, a strainer configured to filter oil to be supplied to the power unit is provided in the first reservoir, the strainer includes a first strainer portion and a second strainer portion, and the first strainer portion is formed as one piece with the separator.

In a fifth aspect of the present invention, in the oil pan structure of the fourth aspect, the separator includes a first separator portion and a second separator portion, the first strainer portion is formed as one piece with the first separator portion, and the second strainer portion is formed as one piece with the second separator portion.

In a sixth aspect of the present invention, in the oil pan structure of the first or second aspect, a straightening means configured to straighten a flow of oil is formed in an oil guide part, and the straightening means projects upward from the oil guide part, and extends along the oil guide part.

In a seventh aspect of the present invention, in the oil pan structure of the first or second aspect, the oil pan body includes a protrusion protruding toward the reservoir, the separator includes an interference prevention portion configured to prevent interference with the protrusion, and an oil guide surface is provided on a surface of the interference prevention portion toward the first reservoir.

In an eighth aspect of the present invention, a separator provided in an oil pan including a reservoir configured to store oil circulated in a power unit and returned to the reservoir, includes a vertically extending sidewall unit configured to partition the reservoir into a first reservoir and a second reservoir. The separator partitions an inside of the oil pan such that oil is allowed to flow between the first reservoir and the second reservoir. In the separator, the first reservoir includes a suction-member-placement region in which a member for sucking oil is provided, and the separator has an oil guide surface extending, to the suction-member-placement region, from a portion below a downstream end of an oil passageway configured to allow oil circulated in the power unit to return to the first reservoir.

ADVANTAGES OF THE INVENTION

In the first aspect, oil returned after having circulated in parts of the power unit, collected in the oil passageway, and dropped from the downstream end of the oil passageway, is guided to the suction-member-placement region along the oil guide surface. Accordingly, the contact area of oil returned from the power unit with the separator per a unit amount of oil can be reduced. Thus, oil warmed in the power unit can be guided to the suction-member-placement region while being kept warm. As a result, oil exhibiting low viscosity and high lubrication performance can be supplied to the power unit again even immediately after a cold start of the power unit, for example.

In the second aspect, since the oil receiver is located on top of the oil guide surface, the oil receiver can be located closer to the downstream end of the oil passageway, and thus oil dropped from the downstream end of the oil passageway can be received at a position closer to the oil passageway. Accordingly, it is possible to reduce mixture of air in oil during dropping of the oil, as much as possible. As a result, oil exhibiting high lubrication performance can be supplied to the power unit again.

In the third aspect, when the temperature of oil in the first reservoir is lower than a given temperature, the opening/closing means closes the communication portion to guide oil returned from the power unit to the first reservoir. On the other hand, when the temperature of oil in the first reservoir is equal to or higher than the given temperature, the opening/closing means opens the communication portion to guide oil returned from the power unit, from the communication portion to the second reservoir. In this manner, the temperature of oil in the first reservoir and the temperature of oil in the second reservoir can be adjusted.

In the fourth aspect, the first strainer portion is formed as one piece with the separator. Accordingly, in assembly of the first strainer portion and the second strainer portion, the relative positions of the strainer and the oil guide surface are less likely to be shifted. With this configuration, oil warmed after having circulated in parts of the power unit can always return to the same position in the oil suction port unit of the strainer. Thus, oil exhibiting high lubrication performance can be continuously supplied to the power unit. Moreover, the first strainer portion is fowled as one piece with the separator, and the second strainer portion is mounted to the first strainer portion. Thus, the strainer can be easily mounted to the separator, thereby reducing the number of processes of assembly.

In the fifth aspect, the first strainer portion is formed as one piece with the first separator portion of the separator, and the second strainer portion is formed as one piece with the second separator portion of the separator. Accordingly, when the first separator portion and the second separator portion are coupled together to form the separator, the relative positions of the strainer and the oil guide surface are less likely to be shifted. Thus, as in the fourth aspect, oil exhibiting high lubrication performance can be continuously supplied to the power unit. Further, in the fifth aspect, the first strainer portion is formed as one piece with the first separator portion of the separator, the second strainer portion is formed as one piece with the second separator portion of the separator, and the first separator portion and the second separator portion are coupled together. Thus, the strainer can be easily mounted to the separator, thereby reducing the number of processes of assembly.

In the sixth aspect, the straightening means straightens a flow of oil on the oil guide surface, thereby preventing disturbances of the oil flow. As a result, mixture of air in oil due to disturbance of the oil flow can be reduced, thereby reducing degradation of lubrication performance of oil.

In the seventh aspect, the interference prevention portion formed to avoid interference with the protrusion of the oil pan body is utilized to guide oil returned after having circulated in parts of the power unit, to the suction-member-placement region of the first reservoir along the oil guide surface formed in the interference prevention portion. Accordingly, oil warmed after having circulated in parts of the power unit is supplied to the power unit through a member for sucking oil again before the oil is cooled, thereby allowing oil exhibiting high lubrication performance to be supplied to the power unit.

In the eighth aspect, oil returned after having circulated in parts of the power unit, collected in the oil passageway, and dropped from the downstream end of the oil passageway, is guided to the suction-member-placement region along the oil guide surface. Accordingly, the contact area of oil returned from the power unit with the separator per a unit amount of oil can be reduced, and thus, oil warmed in the power unit can be guided to the suction-member-placement region while being kept warm. As a result, as in the first aspect, oil exhibiting high lubrication performance can be supplied to the power unit again.

DETAILED DESCRIPTION

An embodiment of the present invention will be described in detail hereinafter with reference to the drawings. The following embodiment is merely examples in nature, and is not intended to limit the scope, applications, and use of the invention.

Figure 1:
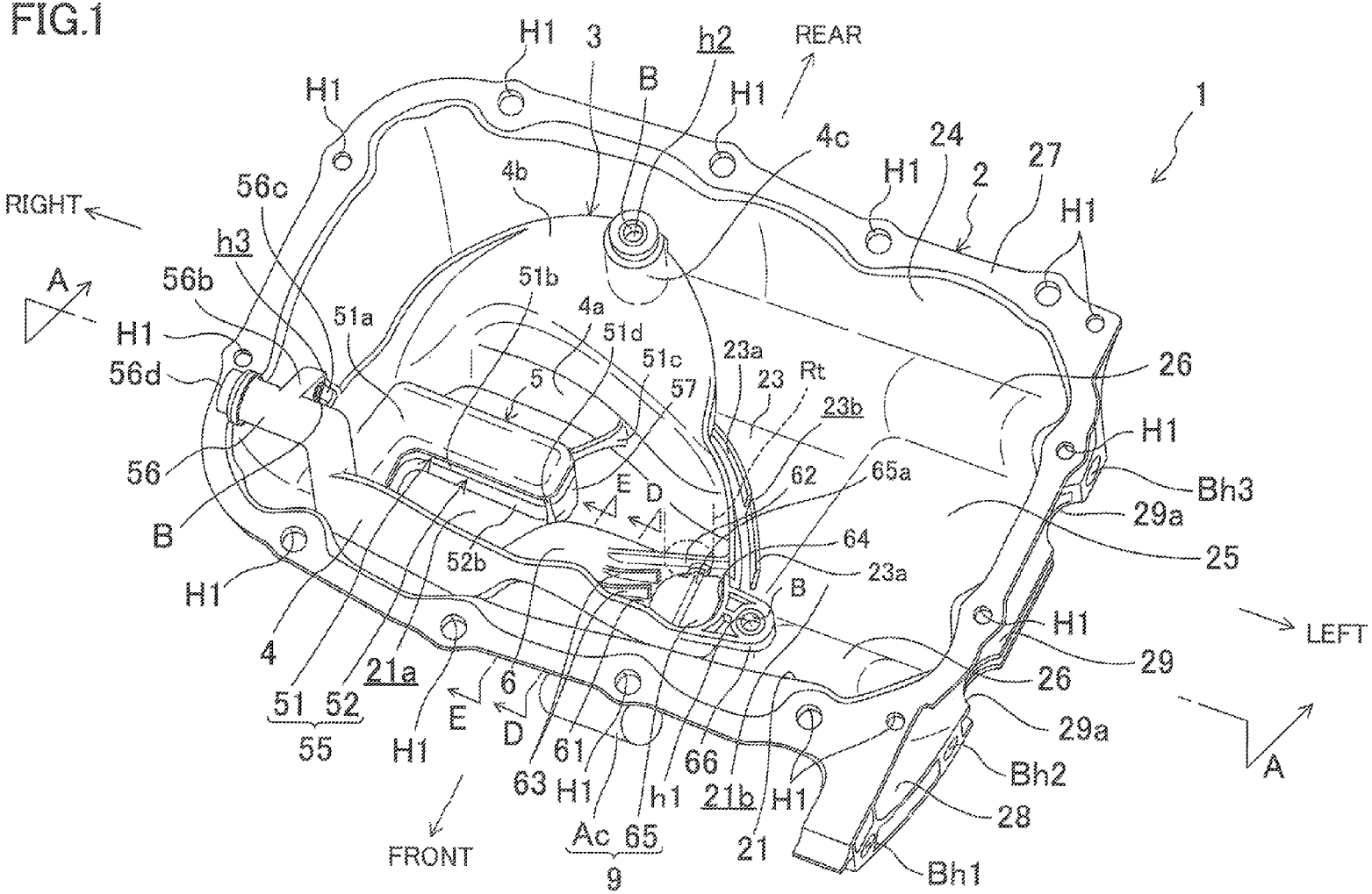
FIG. 1 is a perspective view illustrating an oil pan according to the present invention.
Figure 2:
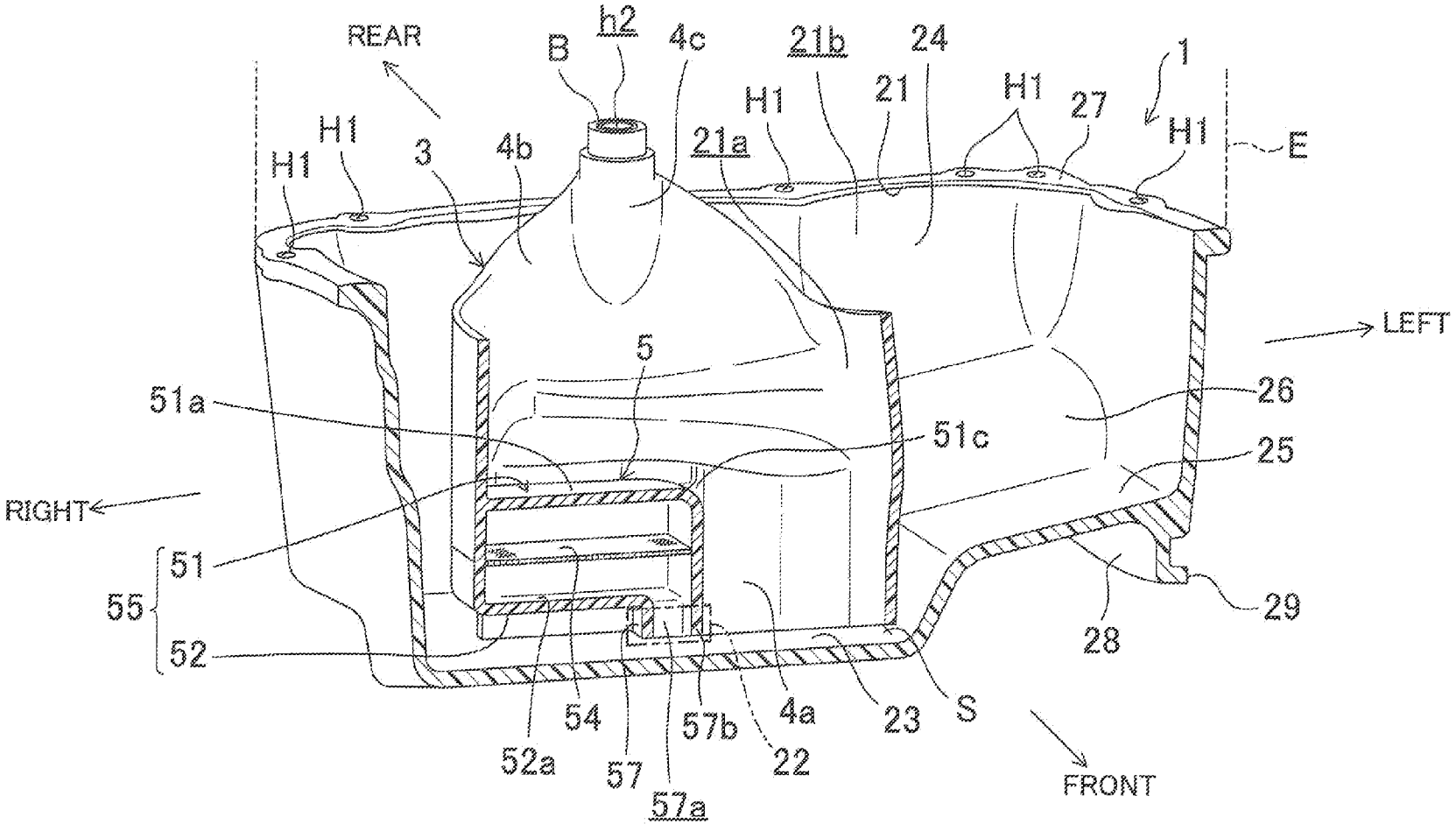
FIG. 2 is a cross-sectional view taken along line A-A in FIG. 1.

FIG. 1 illustrates an oil pan 1 according to the present invention. The oil pan 1 is for use in an engine (a power unit) E to be placed in an engine compartment at the front of an automobile, and is attached to a lower portion of the engine E, as illustrated in FIG. 2. Oil accumulated in the oil pan 1 is supplied to, and circulates in, parts of the engine E, and then returns to the oil pan 1. The engine E placed in the engine compartment is positioned such that the crank shaft extends in the right-to-left direction of the automobile.

In the embodiment, the front side of the automobile is referred as the "front," the rear side of the automobile is referred to as the "rear," the left side of the automobile is referred as the "left," and the right side of the automobile is referred as the "right," for convenience of description.

As illustrated in FIG. 1, the oil pan 1 includes: an oil pan body 2 having a reservoir 21 which is open at the top thereof and stores oil; and a separator 3 having an annular sidewall unit 4 located in the oil pan body 2 and extending vertically. The separator 3 partitions the reservoir 21 into a first reservoir 21*a* located inside the separator 3 and a second reservoir 21*b* located outside the separator 3. In this embodiment, the temperature of oil in the first reservoir 21*a* is higher than the temperature of oil in the second reservoir 21*b*. As illustrated in FIG. 2, the separator 3 is located in the oil pan body 2 such that a gap S is formed between the bottom of the sidewall unit 4 of the separator 3 and the oil pan body 2. Oil accumulated in the reservoir 21 is allowed to flow between the first reservoir 21*a* and the second reservoir 21*b* through the gap S.

The oil pan body 2 is an injection molded part made of resin and having the shape of a substantially rectangular parallelepiped. As illustrated in FIGS. 1 and 2, the oil pan body 2 includes: a bottom wall 23 which is substantially rectangular in plan view; and a peripheral wall 24 rising from the periphery of the bottom wall 23. As illustrated in FIG. 1, the reservoir 21 of this embodiment is a component for storing oil, formed by the bottom wall 23 and the peripheral wall 24 rising from the periphery of the bottom wall 23.

As illustrated in FIGS. 1 and 2, the bottom wall 23 is long in the right-to-left direction, and an upward step 25 is formed on a left portion of the bottom wall 23. The step 25 extends from the left end of the bottom wall 23 to a portion at the left of the middle of the bottom wall 23 in the right-to-left direction. Protrusions 26 and 26 directed toward the reservoir 21 are respectively formed at the front and rear edges of the bottom wall 23, and extend from the left end of the bottom wall 23 to portions at the right of the middle of the bottom wall 23 in the right-to-left direction. As illustrated in FIG. 2, the tops of the protrusions 26 and 26 are located above the step 25. As illustrated in FIG. 1, partitions 23*a*, 23*a*, . . . projecting upward and partially surrounding the bottom of the separator 3, are formed on the bottom wall 23 of the oil pan body 2. A gap 23*b* is provided between each adjacent ones of the partitions 23*a*, thereby allowing oil to flow between the first reservoir 21*a* and the second reservoir 21*b* through the partitions 23*a*. Accordingly, even when the oil pan 1 is inclined, the partitions 23*a* enable oil to accumulate in the first reservoir 21*a*, thereby keeping the oil level higher than a strainer 5, which will be described later. As a result, it is possible to prevent air from being sucked into the strainer 5.

The suction-member-placement region 22 herein is a region enclosed by chain double-dashed lines in FIG. 2, and is located on the bottom of the reservoir 21 at the right of the middle, in the front-to-rear direction, of the reservoir 21. An oil suction port 57*b* of the strainer 5 is located in this suction-member-placement region 22 when the separator 3 is placed in the oil pan body 2.

A flange 27 projecting outward is formed on the upper periphery of the peripheral wall 24 to be perpendicular to the peripheral wall 24. The flange 27 has a plurality of fastening holes H1 though which fastening bolts (not shown) for fastening the oil pan body 2 to the engine E are inserted.

As illustrated in FIG. 1, a left portion of the peripheral wall 24 of the oil pan body 2 is configured to be fastened to a casing (not shown) of a transmission. As illustrated in FIGS. 1 and 2, sidewall flanges 28 and 28 respectively projecting forward and downward are provided on the left portion of the peripheral wall 24. A projection 29 projecting to the left is continuously formed on the front and bottom edges of the sidewall flanges 28. Notches 29*a* and 29*a* are formed in the left edge of a portion of the projection 29 on the bottom edge of the sidewall flanges 28, and are symmetric with respect to the middle, in the front-to-rear direction, of the oil pan body 2. Bolt-insertion holes Bh1 through Bh3 through which fastening bolts (not shown) for fastening the oil pan 1 to the casing (not shown) of the transmission are formed in the projection 29 to penetrate the projection 29 in the right-to-left direction. The bolt-insertion hole Bh1 is located in a front upper portion of the projection 29. The bolt-insertion hole Bh2 is located in a front lower portion of the projection 29 at a position associated with one of the protrusions 26. In the same manner, the bolt-insertion hole 13*h*3 is located at a rear lower portion of the projection 29 at a position associated with the other protrusion 26. Accordingly, when fastening bolts (not shown) are inserted in the bolt-insertion holes Bh2 and Bh3 to fasten the oil pan 1 to the casing (not shown) of the transmission, the protrusions 26 can prevent tools for fastening the fastening bolts (not shown) to the oil pan 1 and the oil pan 1 from interfering with each other.

The separator 3 is disposed in the oil pan body 2, and is open at its top and bottom. The separator 3 includes: the sidewall unit 4 described above; and the strainer 5 which filters oil to be accumulated in the reservoir 21 before the oil circulates in parts of the engine E so as to remove impurities.

Figure 3:
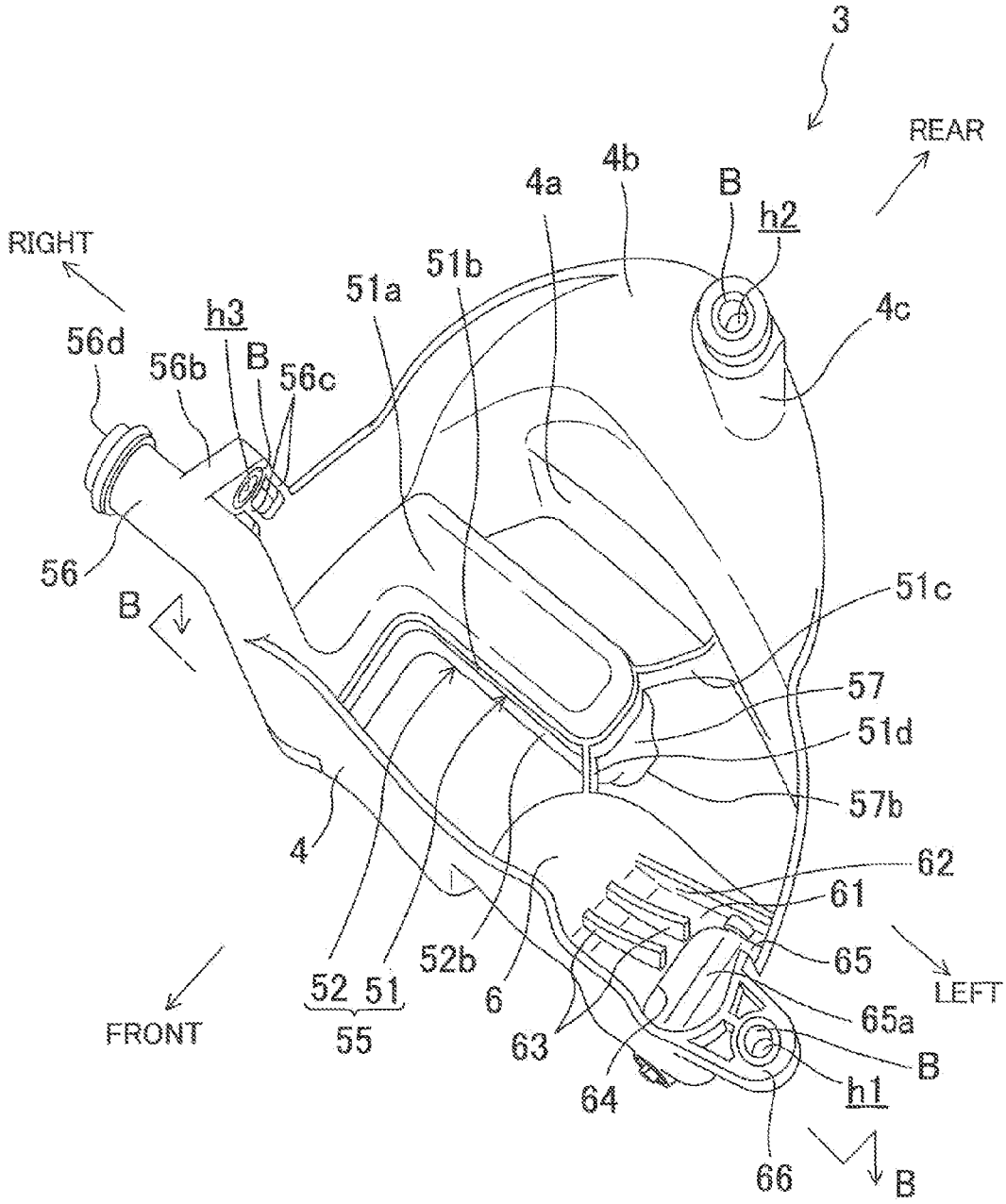
FIG. 3 is a perspective view of a separator according to the present invention when viewed from above the separator.
Figure 4:
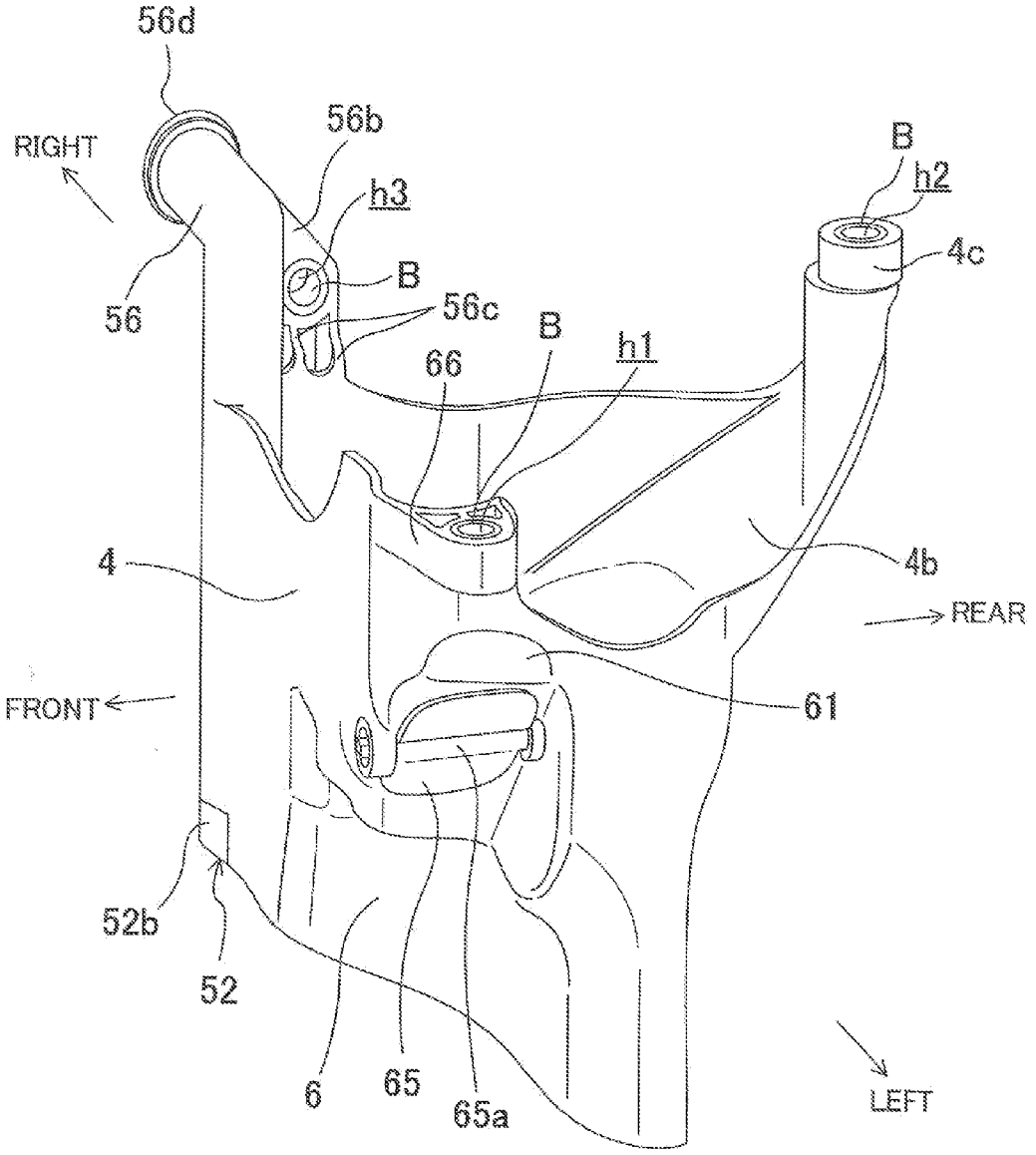
FIG. 4 is a perspective view of the separator when viewed from the left of the separator.
Figure 7A:
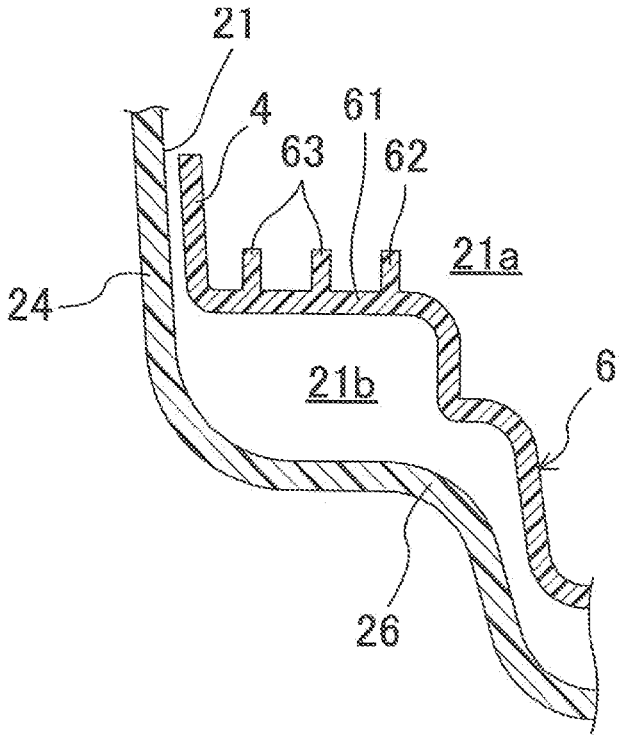
FIG. 7A is a cross-sectional view taken along line D-D in FIG. 1.
Figure 7B:
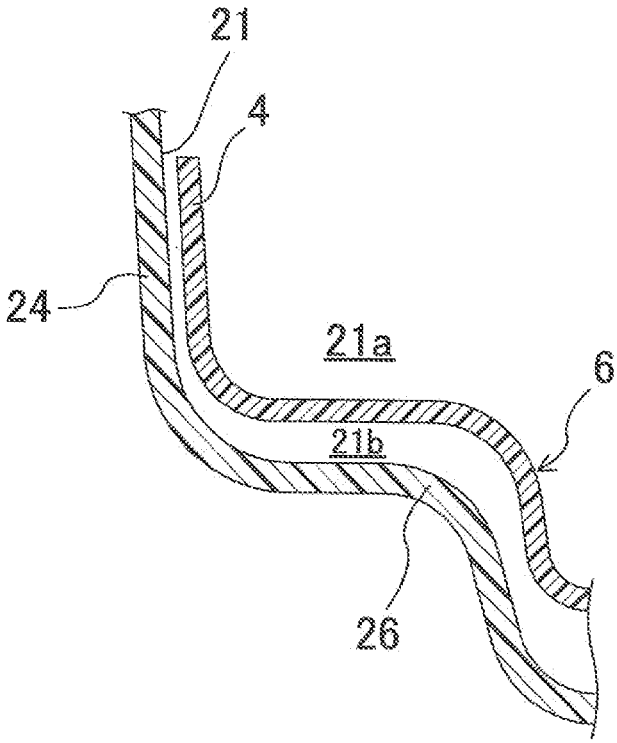
FIG. 7B is a cross-sectional view taken along line E-E in FIG. 1.

As illustrated in FIGS. 3 and 4, the width of the sidewall unit 4 in the right-to-left direction is larger than the width of the sidewall unit 4 in the front-to-rear direction in plan view. As illustrated in FIGS. 7A and 7B, an interference prevention portion 6 for preventing the oil pan body 2 from interfering with the protrusion 26 is provided in a left portion of a front sidewall of the sidewall unit 4. The interference prevention portion 6 is recessed toward the first reservoir 21*a*. As illustrated in FIG. 7B, a right portion of the interference prevention portion 6 is recessed toward the first reservoir 21*a* along the protrusion 26 of the oil pan body 2. As illustrated in FIG. 7A, in a left portion of the interference prevention portion 6, an upper portion is recessed toward the first reservoir 21*a* more greatly than a lower portion, the lower portion is formed along the protrusion 26, and a gap with a given size is formed between the interference prevention portion 6 and the protrusion 26. The gap formed between the protrusion 26 and the interference prevention portion 6 is large enough to prevent the protrusion 26 and the interference prevention portion 6 from coming into contact with each other upon vibration of the engine E. The interference prevention portion 6 does not need to be formed along the protrusion 26. As illustrated in FIGS. 3 and 4, an inclined portion (an oil guide surface) 61 gradually rises toward the left end is formed in a left portion of the interference prevention portion 6. The top of the inclined portion 61 is located on the upper periphery of the sidewall unit 4. As illustrated in FIG. 1, the downstream end of a return pipe Rt which is part of an oil passageway for guiding oil returned from the engine E to the inclined portion 61, is located above the inclined portion 61. Most part of oil circulated in parts of the engine E is collected in the return pipe Rt. The collected oil is returned to the inclined portion 61 through the return pipe Rt, and flows toward the suction-member-placement region 22 of the first reservoir 21*a* along the inclined portion 61. Accordingly, oil returned after having circulated in parts of the engine E, collected in the return pipe Rt, and dropped from the downstream end of the return pipe Rt into the inclined portion 61, is guided to the suction-member-placement region 22 along the inclined portion 61. Thus, the contact area of oil from the engine E with the inclined portion 61 per a unit amount of oil can be reduced, and thereby, oil warmed in parts of the engine E is guided to the suction-member-placement region 22 while being kept warm.

A plate-like inclined wall 62 projecting upward and extending along the inclined portion 61 is fanned on the rear periphery of the inclined portion 61. A communication hole (a communication portion) 64 communicating with the first reservoir 21*a* and the second reservoir 21*b* is formed in a left portion of the inclined portion 61, i.e., immediately under the return pipe Rt. An opening/closing plate (an oil receiver) 65 is attached to the inclined portion 61 to close the communication hole 64. The opening/closing plate 65 is in the shape of a substantially rectangular plate, and is tilted along the slope of the inclined portion 61. The opening/closing plate 65 is located above the inclined portion 61, and is close to the downstream end of the return pipe Rt. Accordingly, the opening/closing plate 65 can receive oil dropped from the downstream end of the return pipe Rt at a position closer to the downstream end, thereby reducing mixture of air in oil during dropping of the oil, as much as possible. A central shaft 65*a* extending in the front-to-rear direction is provided at the middle, in the right-to-left direction, of the opening/closing plate 65 to intersect a flow of oil on the inclined portion 61. The front and rear ends of the central shaft 65*a* are rotatably attached to the sidewall unit 4 and the interference prevention portion 6, respectively. As illustrated in FIG. 3, the front end of the central shaft 65*a* penetrates the sidewall unit 4, and projects forward from the sidewall unit 4. The front end of the central shaft 65*a* is connected to a known actuator Ac (illustrated in FIG. 1). The actuator Ac allows the opening/closing plate 65 to be rotatable about the central shaft 65*a*. An opening/closing means 9 according to the present disclosure includes the opening/closing plate 65 and the actuator Ac. When the temperature of oil in the first reservoir 21*a* measured with, for example, a temperature sensor provided in the first reservoir 21*a* is higher than a set value, the actuator Ac causes the opening/closing plate 65 to rotate counterclockwise about the central shaft 65*a* as viewed from the front. Then, the right half of the opening/closing plate 65 is positioned to extend downward from the central shaft 65*a*, and the left half of the opening/closing plate 65 is positioned to extend upward from the central shaft 65*a*, thereby opening the communication hole 64. Accordingly, when it is determined that the temperature of oil in the first reservoir 21*a* excessively increases to degrade lubrication performance of the oil, oil returned from the return pipe Rt is guided to the second reservoir 21*b*. On the other hand, when the temperature sensor, for example, shows that the temperature of oil in the first reservoir 21*a* is lower than the set value, the actuator Ac causes the opening/closing plate 65 to rotate clockwise about the central shaft 65*a* as viewed from the front, and the opening/closing plate 65 closes the communication hole 64 to allow oil to flow along the inclined portion 61. Accordingly, the temperature of oil in the first reservoir 21*a* and the temperature of oil in the second reservoir 21*b* can be adjusted with the opening/closing plate 65. The opening/closing plate 65 may be a thermostatic valve.

Two plate-like straightening vanes (straightening means) 63 projecting upward and extending along the inclined portion 61 are formed on the top surface of the inclined portion 61. The two straightening vanes 63 are parallel to each other, and are disposed in the front-to-rear direction. The height of the straightening vanes 63 decreases toward the right. The upstream ends of the straightening vanes 63 in the oil flow are located at a right portion of the periphery of the communication hole 64. These straightening vanes 63 straighten the flow of oil on the inclined portion 61, and thus air is less likely to be mixed in the oil.

A plate-like attachment portion 66 projecting to the left is formed on top of the inclined portion 61. A fastening hole h1 through which a fastening bolt (not shown) is inserted in attaching the separator 3 to the engine E, is formed in the center of the attachment portion 66, and vertically penetrates the attachment portion 66. A bushing B is fitted into the fastening hole h1.

Figure 6:
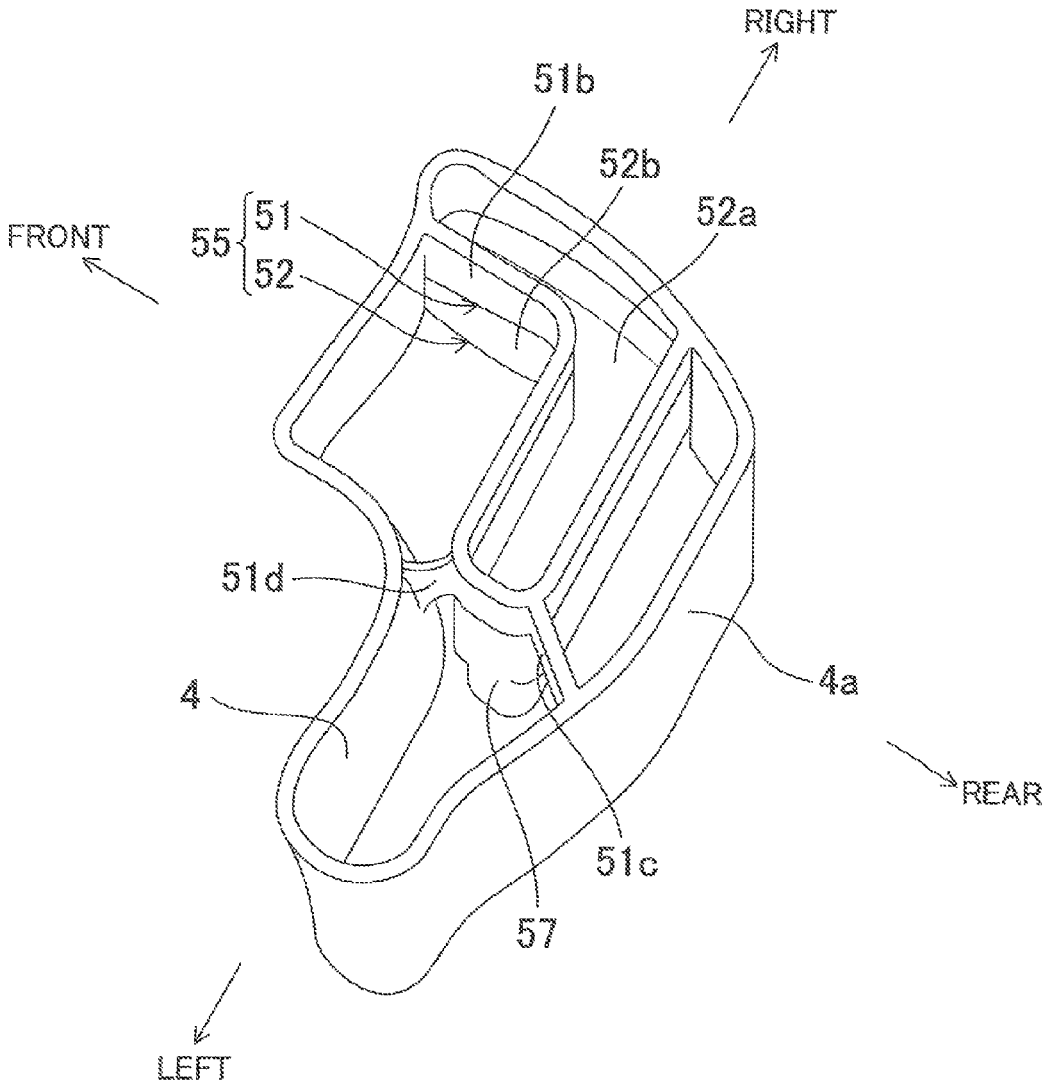
FIG. 6 is a cross-sectional view taken along line B-B in FIG. 3.

As illustrated in FIG. 1, a rear-wall protrusion 4*a* protruding forward is formed on a lower portion of a rear sidewall of the sidewall unit 4. The rear-wall protrusion 4*a* is a forward-projecting lower half of the rear sidewall of the sidewall unit 4. As illustrated in FIG. 6, the front end of the rear-wall protrusion 4*a* is located at a given distance from the strainer 5. As illustrated in FIGS. 3 and 4, a rear-wall slope 4*b* rising toward the rear is formed in an upper portion of the rear sidewall of the sidewall unit 4. The upper edge of the rear-wall slope 4*b* is curved such that the middle, in the right-to-left direction, of the upper edge is at the highest position which is located above the top of a front sidewall of the sidewall unit 4. A cylinder portion 4*c* projecting upward is formed on the middle, in the right-to-left direction, of the rear end of the rear-wall slope 4*b*. A fastening hole h2 through which a fastening bolt (not shown) is inserted in attaching the separator 3 to the engine E, is formed in the center of the cylinder portion 4*c*, and vertically penetrates the cylinder portion 4*c*. A bushing B is fitted into the fastening hole h2.

As illustrated in FIG. 2, the strainer 5 includes: a filter housing 55 housing a filter 54 for filtering oil; and a discharge pipe 56 connected to an oil pump (not shown).

Figure 5:
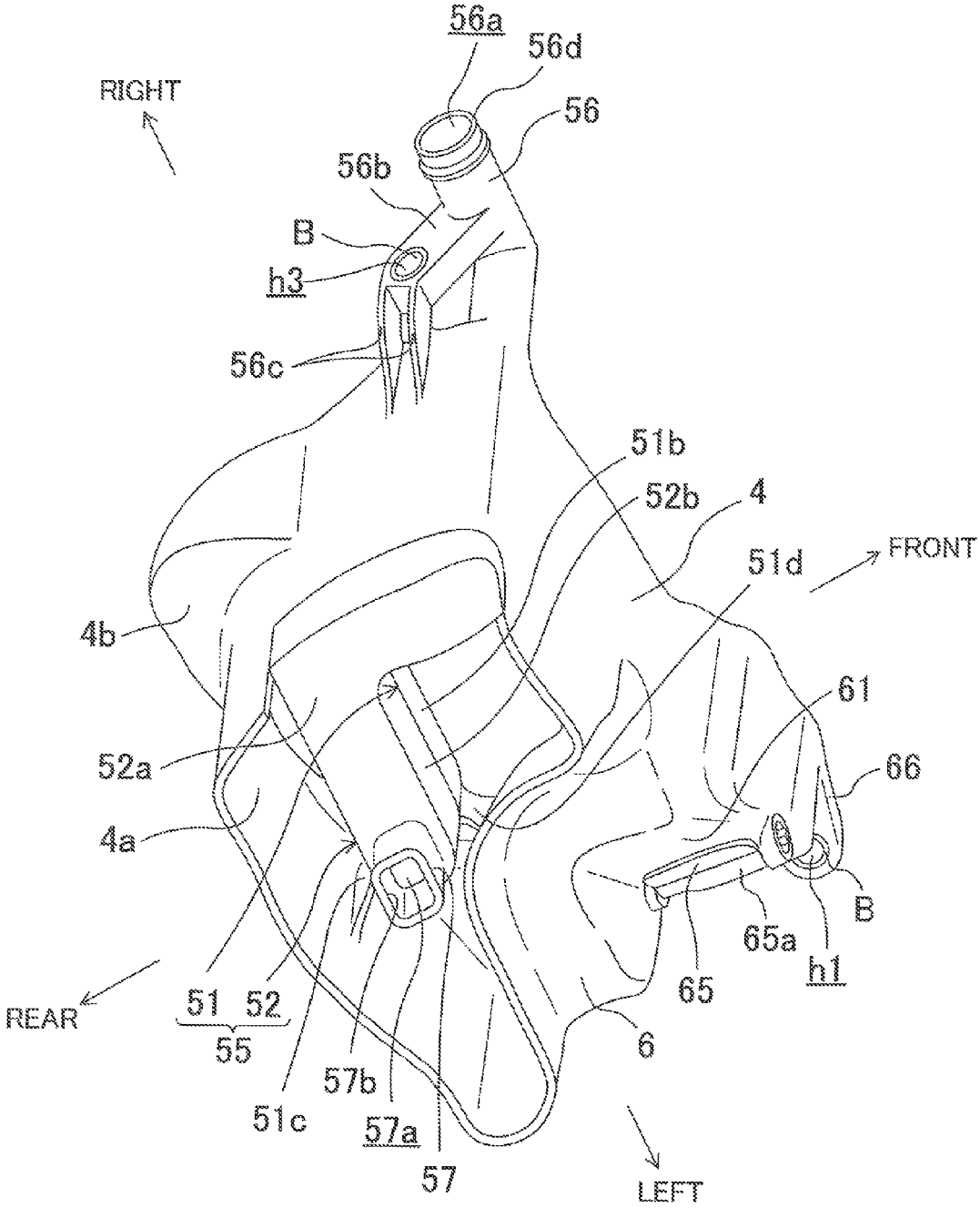
FIG. 5 is a perspective view of the separator when viewed from the bottom of the separator.

The filter housing 55 forms an L shape in plan view, and more specifically, extends rearward from a portion between front and right sidewalls of the sidewall unit 4 along the right sidewall, and then bends to the left at the middle, in the front-to-rear direction, of the right sidewall. The left end of the filter housing 55 is located substantially at the center of the separator 3. As illustrated in FIG. 5, the filter housing 55 is partitioned in the thickness direction into two: an upper portion (a first strainer portion) 51 located downstream; and a lower portion (a second strainer portion) 52 located upstream.

The upper portion 51 is formed as one piece with the sidewall unit 4, and has a C shape in cross section. The C shape is made of an L-shaped upper wall 51*a* which extends rearward from a portion between the front and right sidewalls of the sidewall unit 4 along the right sidewall and then bends to the left at the middle, in the front-to-rear direction, of the right sidewall, and an upper peripheral wall 51*b* projecting downward from the periphery of the upper wall 51*a*.

Plate-like bridges 51*c* and 51*d* connected to the sidewall unit 4 are formed upstream of the upper portion 51. The bridge 51*c* is in the shape of an upright plate, and extends to the left and rear from a rear portion of the upstream end to be connected to the rear sidewall of the sidewall unit 4. The bridge 51*d* is in the shape of an upright plate, and connects an upstream portion of the front end of the upper portion 51 to the interference prevention portion 6.

The discharge pipe 56 is provided downstream of the upper portion 51, and is formed as one piece with the upper portion 51. As illustrated in FIG. 3, the discharge pipe 56 is a circular pipe, and has an L shape. Specifically, the discharge pipe 56 extends straight upward from a portion of the top surface of the upper wall 51*a* between the right and front sidewalls of the sidewall unit 4, then bends to the right at a position slightly above the top of the right sidewall of the sidewall unit 4, and then extends straight. An oil outflow opening 56*a* is formed in the discharge pipe 56. The upstream end of the discharge pipe 56 is open, and communicates with the inside of the filter housing 55. An oil outflow port 56*d* is formed at the downstream end of the discharge pipe 56.

A plate-like attachment portion 56*b* obliquely extending to the bottom and rear is formed in a downstream portion of the discharge pipe 56 extending to the right. A fastening hole h3 through which a fastening bolt (not shown) is inserted in attaching the separator 3 to the engine E, is formed in the attachment portion 56*b*, and penetrates the attachment portion 56*b* in the right-to-left direction. A bushing B is fitted into the fastening hole h3.

Two plate-like reinforcing ribs 56*c* projecting downward and connected to the right sidewall of the sidewall unit 4 are disposed side by side in the front-to-rear direction on an end portion of the projection of the attachment portion 56*b*. Each of the reinforcing ribs 56*c* is substantially an inverted triangle. Specifically, in each of the reinforcing ribs 56*c*, the right side gradually approaches the left side to form a vertex at the bottom thereof.

As illustrated in FIGS. 5 and 6, the lower portion 52 has a C shape in cross section. The C shape is made of an L-shaped bottom wall 52*a* facing the upper wall 51*a* of the upper portion 51 and a lower peripheral wall 52*b* projecting upward from the periphery of the bottom wall 52*a*. An oil suction port unit 57 is provided upstream of the lower portion 52, and is formed as one piece with the lower portion 52. As illustrated in FIG. 5, the oil suction port unit 57 is substantially rectangular in cross section, and projects downward from a left portion of the end of the bottom wall 52*a*. An oil inflow opening 57*a* is formed in the oil suction port unit 57, and communicates with the inside of the filter housing 55. An oil suction port 57*b* is formed at the upstream end of the oil suction port unit 57, and is located in the suction-member-placement region 22 of the first reservoir 21*a*.

The filter 54 is made of a plate-like resin material, and as illustrated in FIG. 2, is placed between the upper portion 51 and the lower portion 52.

The filter housing 55 may extend straight, or may be curved, in extending from the corner between the front sidewall and the right sidewall of the sidewall unit 4 to an approximate center of the separator 3. In other words, the filter housing 55 only needs to have such a shape that the oil suction port 57*b* of the filter housing 55 is located in the suction-member-placement region 22.

Assembly of the oil pan 1 in the engine E will be described hereinafter. As illustrated in FIGS. 1 and 2, the separator 3 is placed under the engine E. Fastening bolts (not shown) are inserted in the fastening hole h1 in the attachment portion 66, the fastening hole h2 in the cylinder portion 4*c*, and the fastening hole h3 in the attachment portion 56*b*, to fasten the separator 3 to the engine E. Then, the oil pan body 2 is placed under the engine E to cover the separator 3, and fastening bolts (not shown) are inserted into the fastening holes h in the flange 27 from blow the flange 27, to fasten the oil pan body 2 to the engine E. In this placement, since the interference prevention portion 6 is formed in the separator 3, the separator 3 does not interfere with the protrusion 26 of the oil pan body 2, as illustrated in FIG. 7. In addition, as illustrated in FIG. 2, the bottom of the sidewall unit 4 of the separator 3 is located above the bottom wall 23 of the oil pan body 2, and thus a gap S is formed between the bottom of the sidewall unit 4 and the bottom wall 23 to allow oil in the reservoir 21 to flow between the first reservoir 21*a* and the second reservoir 21*b*.

A flow of oil in the oil pan 1 will be described hereinafter. First, at a cold start, since the temperature of oil in the first reservoir 21*a* is low, the opening/closing plate 65 closes the communication hole 64 so that oil circulated in parts of the engine E is collected in the return pipe Rt, returns from the downstream end of the return pipe Rt onto the opening/closing plate 65 of the interference prevention portion 6, and flows on the inclined portion 61 to the suction-member-placement region 22 of the first reservoir 21*a*, i.e., into a portion near the oil suction port 57*b* of the strainer 5. Accordingly, the contact area of oil from the engine E with the inclined portion 61 per a unit amount of oil can be reduced, and thus oil warmed in the engine E can be supplied to the engine E through the strainer 5 again while being kept warm. As a result, oil exhibiting low viscosity and high lubrication performance can be supplied to the engine E even immediately after a cold start, for example. Since the straightening vanes 63 are formed on the inclined portion 61, the flow of oil on the inclined portion 61 is straightened, and thus air is less likely to be mixed in the oil. In addition, since the opening/closing plate 65 is located above the inclined portion 61, the opening/closing plate 65 can be located closer to the downstream end of the return pipe Rt, and thus oil dropped from the downstream end of the return pipe Rt can be received at a position closer to the return pipe Rt. As a result, mixture of air in oil can be reduced as much as possible during dropping of the oil.

Thereafter, oil in the first reservoir 21*a* is caused to circulate in parts of the engine E, thereby increasing the temperature of the oil in the first reservoir 21*a*. When a temperature sensor (not shown) or the like provided in the first reservoir 21*a* shows that the temperature of the oil in the first reservoir 21*a* is higher than a set value, a known actuator Ac causes the opening/closing plate 65 to rotate, thereby opening the communication hole 64. Accordingly, oil circulated in parts of the engine E and returned, can be guided to the second reservoir 21*b*. Consequently, when the temperature of oil in the first reservoir 21*a* is high, the opening/closing plate 65 is opened, thereby guiding oil returned from the engine E to the second reservoir 21*b* through the communication hole 64. When the temperature of oil in the first reservoir 21*a* is low, the opening/closing plate 65 is closed, thereby allowing oil returned from the engine E to be guided to the first reservoir 21*a* along the inclined portion 61. In this manner, the temperature of oil in the first reservoir 21*a* and the temperature of oil in the second reservoir 21*b* can be adjusted.

As described above, in the oil pan 1 of this embodiment, oil returned after having circulated in parts of the engine E, collected in the return pipe Rt, and dropped from the downstream end of the return pipe Rt, can be guided to the suction-member-placement region 22 along the inclined portion 61. Accordingly, the contact area of oil from the engine E with the inclined portion 61 per a unit amount of oil can be reduced. Oil warmed in the engine E can be guided to the suction-member-placement region 22 while being kept warm. As a result, oil having low viscosity and high lubrication performance can be supplied to the engine E again even immediately after a cold start of the engine E.

In addition, since the opening/closing plate 65 is located above the inclined portion 61, the opening/closing plate 65 can be located closer to the downstream end of the return pipe Rt, and thus oil dropped from the downstream end of the return pipe Rt can be received at a position closer to the return pipe Rt. Accordingly, mixture of air in oil can be reduced as much as possible during dropping of the oil, thereby oil exhibiting high lubrication performance can be supplied to the engine E again.

Further, when the temperature of oil in the first reservoir 21*a* is lower than a given temperature, the opening/closing plate 65 closes the communication hole 64 to guide oil returned from the engine E to the first reservoir 21*a*. On the other hand, when the oil temperature is equal to or higher than the given temperature, the opening/closing plate 65 opens the communication hole 64 to guide oil returned from the engine E to the second reservoir 21*b* through the communication hole 64. Accordingly, the temperature of oil in the first reservoir 21*a* and the temperature of oil in the second reservoir 21*b* can be adjusted.

Moreover, the upper portion 51 is formed as one piece with the separator 3.

Accordingly, when the lower portion 52 is mounted to the upper portion 51, the relative positions of the strainer 5 and the inclined portion 61 are less likely to be shifted. In this configuration, oil warmed while having circulated in parts of the engine E can always return to the same place in the oil suction port unit 57 of the strainer 5. Thus, oil exhibiting high lubrication performance can be continuously supplied to the engine E. Moreover, since the upper portion 51 is formed as one piece with the separator 3 and the lower portion 52 is mounted to the upper portion 51, the strainer 5 can be easily mounted to the separator 3, thereby reducing the number of processes of assembly.

Furthermore, since the straightening vanes 63 straighten the flow of oil on the inclined portion 61 of the interference prevention portion 6, the flow of oil cannot be disturbed. Accordingly, mixture of air in oil due to disturbance of the oil flow can be reduced, thereby reducing degradation of lubrication performance of oil.

The interference prevention portion 6 formed to avoid interference with the protrusion 26 of the oil pan body 2 is utilized to guide oil returned after having circulated in parts of the engine E, to the suction-member-placement region 22 of the first reservoir 21*a* along the inclined portion 61 formed in the interference prevention portion 6. Accordingly, oil warmed while having circulated in parts of the engine E is supplied to the engine E again through the strainer 5 before the oil is cooled. As a result, oil exhibiting high lubrication performance can be supplied to the engine E.

Figure 8:
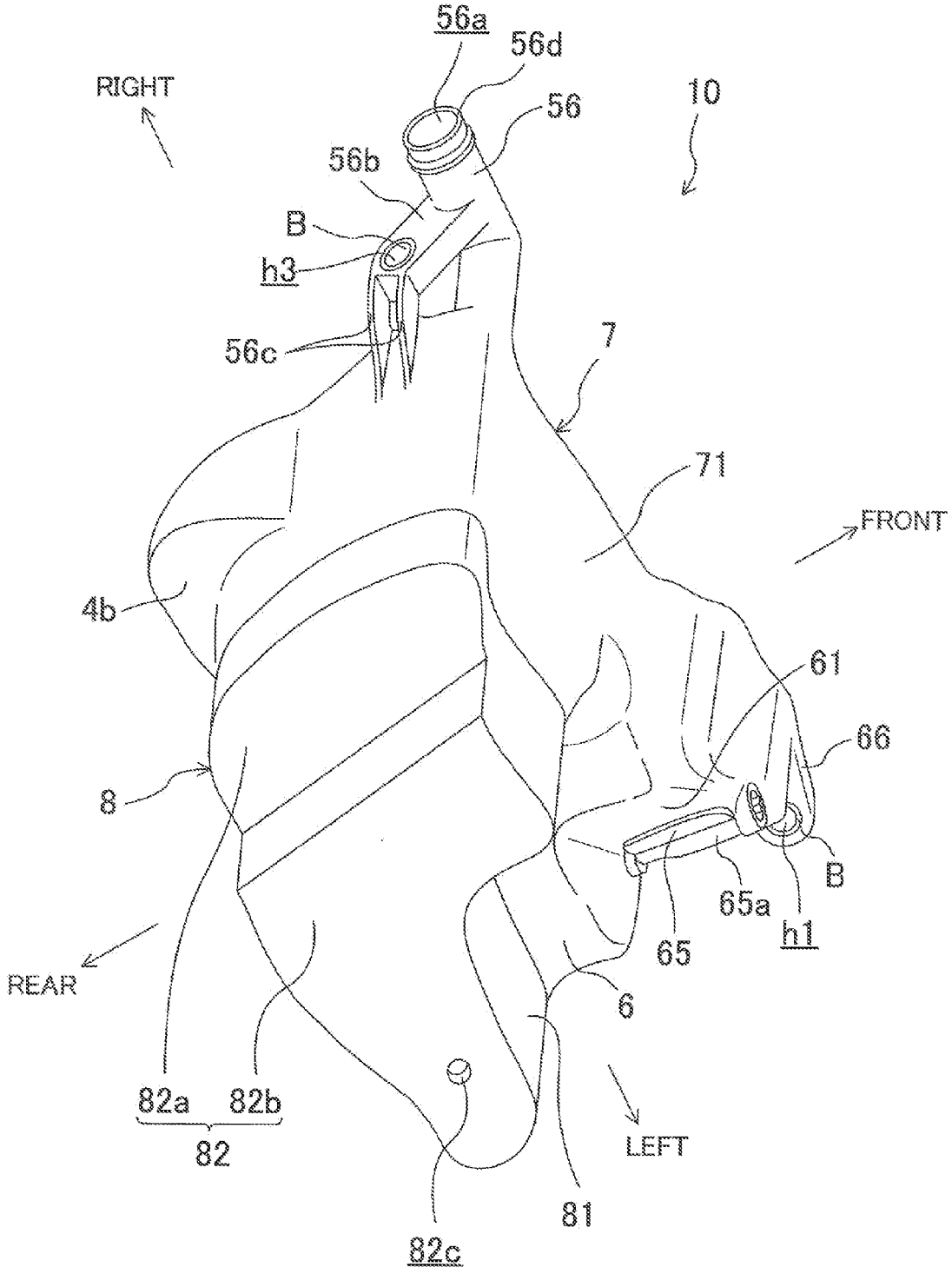
FIG. 8 is a perspective view of a separator according to a modified example of an embodiment of the present invention when viewed from the bottom of the separator.

FIGS. 8-11 illustrate a modified example of the embodiment. This modified example is similar to the above embodiment except for aspects to be described below. The same reference numerals denote the same components in the embodiment, and only different aspects will be described in detail. Specifically, in the modified example, as illustrated in FIG. 8, a separator 10 is vertically partitioned into two, i.e., is formed by coupling an upper separator portion (a first separator portion) 7 and a lower separator portion (a second separator portion) 8 together.

Figure 9:
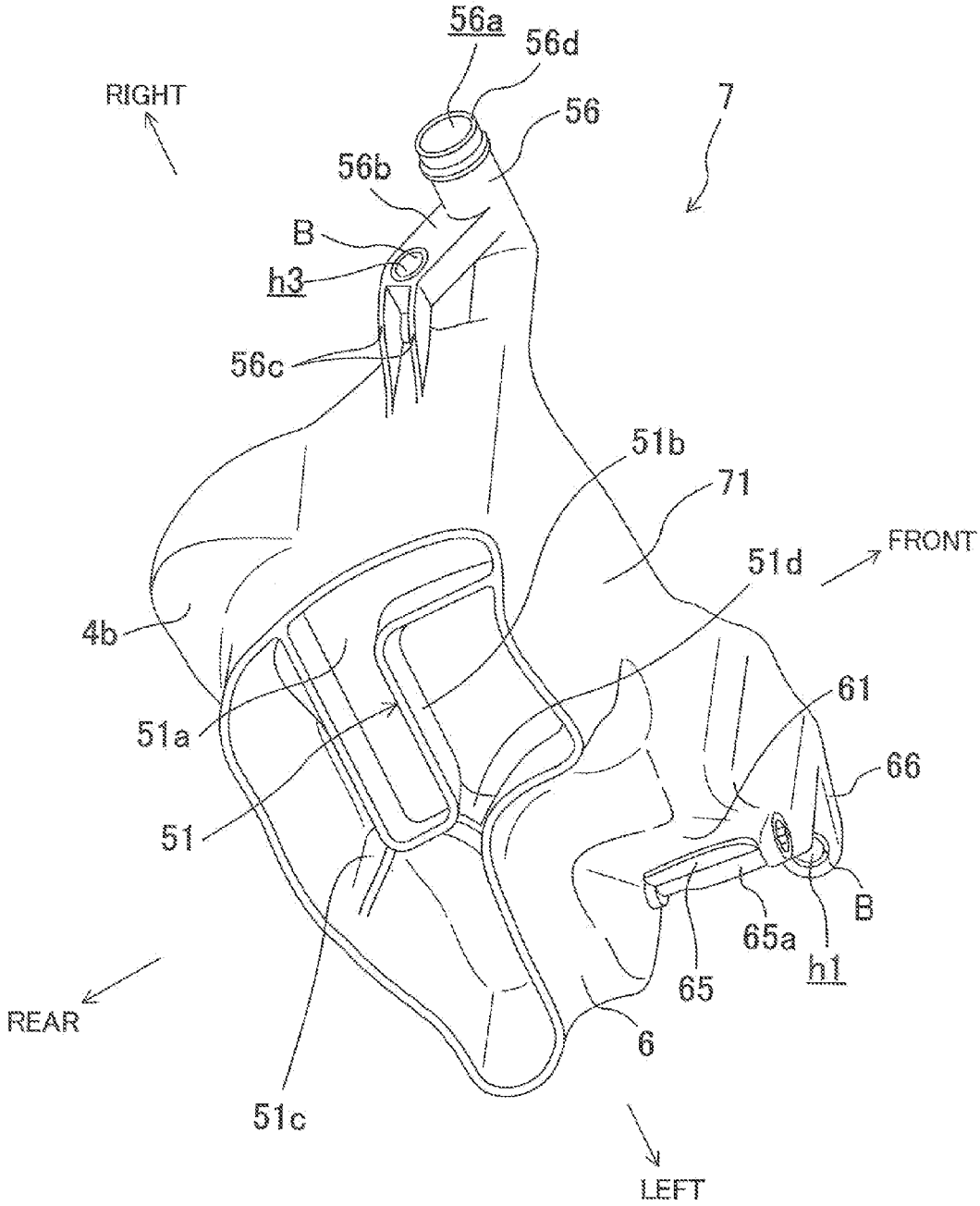
FIG. 9 is a perspective view of an upper separator according to the modified example when viewed from the bottom of the separator.

FIG. 9 illustrates the upper separator portion 7 of the separator 10. The upper separator portion 7 is an injection molded part in which an upper sidewall 71, as an upper part when a sidewall unit 4 is vertically divided into two, is formed as one piece with an upper portion 51 of a strainer 5 and a discharge pipe 56. The shape of the bottom of the upper sidewall 71 matches with the shape of the bottom of an upper peripheral wall 51*b* of the upper portion 51.

Figure 10:
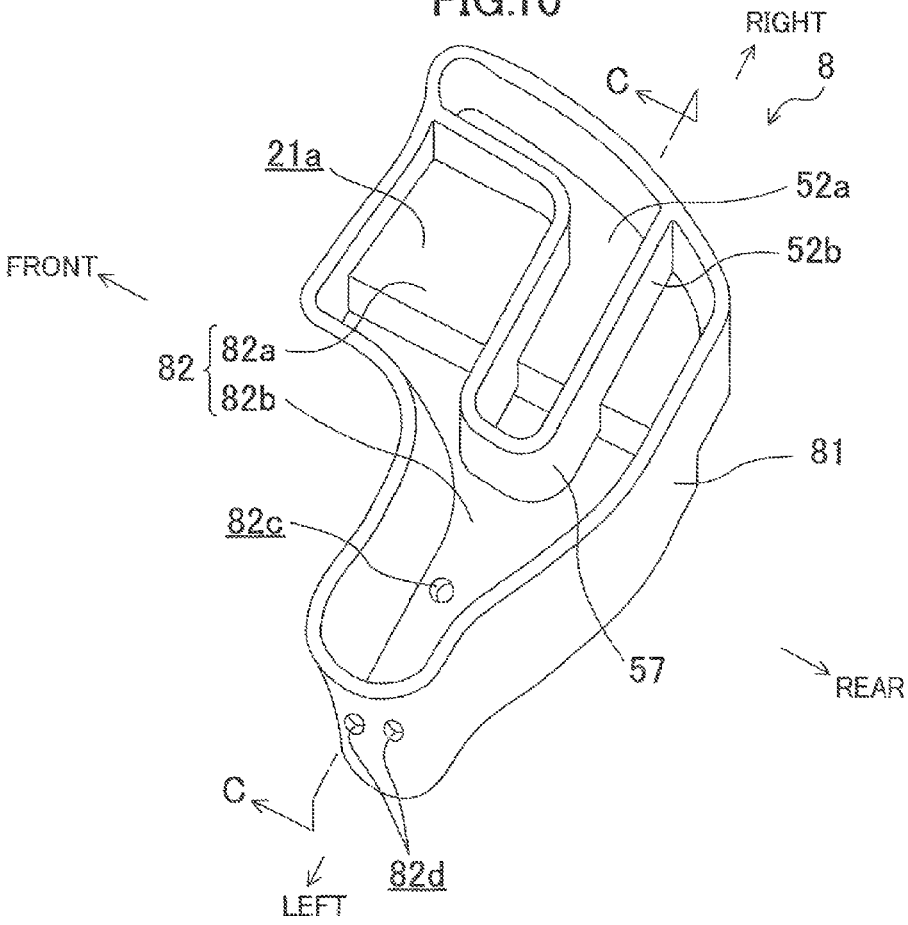
FIG. 10 is a perspective view of a lower separator according to the modified example when viewed from above the separator.
Figure 11:
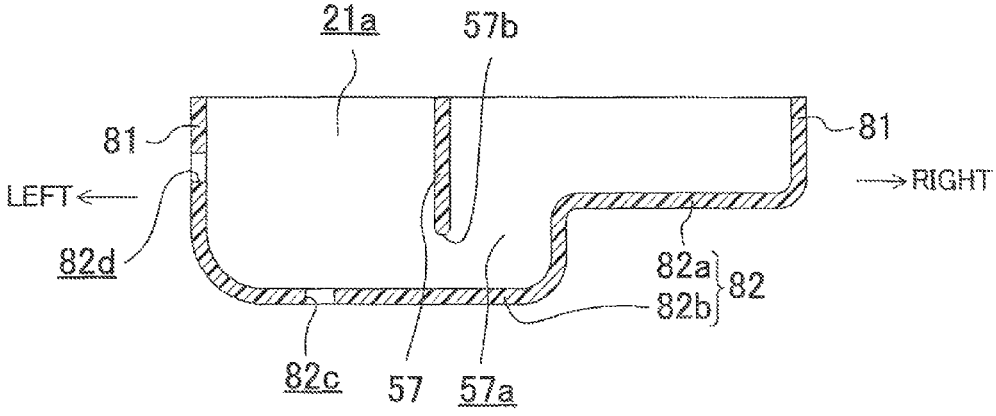
FIG. 11 is a cross-sectional view taken along line C-C in FIG. 10.

FIG. 10 illustrates the lower separator portion 8 of the separator 10. The lower separator portion 8 is an injection molded part in which a lower sidewall 81, as a lower part when the sidewall unit 4 is vertically divided into two, a bottom wall 82 covering a lower portion of the lower sidewall 81, and a lower portion 52 are formed as one piece. As illustrated in FIG. 11, a right bottom wall 82*a*, which is a right half of the bottom wall 82, is located above a left bottom wall 82*b*, which is a left half of the bottom wall 82, to form a level difference. The right bottom wall 82*a* is at the same level as the bottom wall 52*a* of the lower portion 52. The bottom of the oil suction port 57*b* formed in the lower portion 52 is slightly apart from the left bottom wall 82*b*, thereby allowing oil in a first reservoir 21*a* to be sucked.

A through hole 82*c* is formed in the left bottom wall 82*b* to vertically penetrate the left bottom wall 82*b*, thereby allowing oil to flow between the first reservoir 21*a* and a second reservoir 21*b*. This through hole 82*c* can also be used as a drain hole in exchanging oil. Accordingly, the through hole 82*c* is preferably located at the lowest level in the bottom wall 82 in order to facilitate oil draining from the first reservoir 21*a*. In FIG. 10, the through hole 82*c* is located substantially at the center of the left bottom wall 82*b* of the first reservoir 21*a*, but may be located near a curved portion of the bottom wall 82 at the left of the lower sidewall 81. In this case, the through hole 82*c* is located away from the oil suction port unit 57, and thus oil in the second reservoir 21*b* at a temperature lower than that of oil is the first reservoir 21*a* is less likely to be sucked from the oil suction port unit 57 through the through hole 82*c*. Accordingly, in a cold start, for example, the temperature of oil in the first reservoir 21*a* can be increased more quickly, thereby allowing oil with high lubrication performance to be continuously supplied to the engine E.

Two through holes 82*d* are formed to penetrate a left portion of the lower sidewall 81 in the right-to-left direction, and are disposed side by side in the front-to-rear direction, thereby allowing oil to flow between the first reservoir 21*a* and the second reservoir 21*b*. Alternatively, a plurality of through holes 82*c* may be provided, and the number of through holes 82*d* is not specifically limited.

As illustrated in FIG. 10, the first reservoir 21*a* is surrounded by the lower sidewall 81 and the bottom wall 82, and oil flows between the first reservoir 21*a* and the second reservoir 21*b* through the through hole 82*c* and the through holes 82*d*. Accordingly, as compared to a case where the bottom wall 82 is not provided below the lower sidewall 81, heat is less likely to be removed from oil in the first reservoir 21*a* by oil in the second reservoir 21*b*. As a result, in a cold start, for example, the temperature of oil in the first reservoir 21*a* can be increased more quickly, thereby allowing oil with high lubrication performance to be continuously supplied to the engine E.

As described above, the upper sidewall 71, the upper portion 51, and the discharge pipe 56 are formed as one piece to form the upper separator portion 7. The lower sidewall 81 and the lower portion 52 are formed as one piece to form the lower separator portion 8. Then, the upper separator portion 7 and the lower separator portion 8 are coupled together to form the separator 10. Accordingly, in assembly of the separator 10, the relative positions of the strainer 5 and the inclined portion 61 formed in the interference prevention portion 6 are less likely to be shifted. Accordingly, oil warmed after having circulated in parts of the engine E can always return to the same position in the oil suction port unit 57 of the strainer 5. As a result, oil with high lubrication performance can be continuously supplied to the engine E.

Since the upper portion 51 is formed as one piece with the upper separator portion 7 of the separator 10, the lower portion 52 is formed as one piece with the lower separator portion 8 of the separator 10, and the upper separator portion 7 and the lower separator portion 8 are coupled together, the strainer 5 can be easily mounted to the separator 10, thereby reducing the number of processes of assembly.

In the modified example of the embodiment, the separator 3 is vertically divided into two. Alternatively, the separator 3 may be divided in the right-to-left direction or in the front-to-rear direction.

In the modified example of the embodiment, the bottom wall 82 is provided in the lower separator portion 8. Alternatively, the bottom wall 82 may not be provided.

The suction-member-placement region 22 may be located in any portion of the first reservoir 21*a* as long as the suction-member-placement region 22 is located downstream of oil flowing on the inclined portion 61.

The filter housing 55 may have an L shape extending from the corner between the front sidewall and the right sidewall to the rear sidewall of the sidewall unit 4 and then bends to the left along the rear sidewall, and may be in any shape as long as the oil suction port 57*b* of the filter housing 55 is located in the suction-member-placement region 22.

The oil pan body 2 and the separator 3 are not necessarily individually fastened to the engine E, and may be fastened together to the engine E. A configuration in which the separator 3 is mounted to the oil pan body 2 and then the oil pan body 2 is fastened to the engine E, may also be employed.

The oil pan body 2 is not necessarily an injection molded part made of resin, but may be made of iron or an aluminum alloy.

Oil returned from parts of the engine E to the inclined portion 61 is not necessarily returned from the downstream end of the return pipe Rt, and may be returned to the inclined portion 61 from the downstream end of an oil passageway provided in the wall of an engine block, for example.

The opening/closing plate 65 may be located at any position of the inclined portion 61 as long as the opening/closing plate 65 is located at a higher level than the oil surface in the reservoir 21.

The straightening vanes 63 may be provided to a portion of the opening/closing plate 65 toward the first reservoir 21*a*.

The height of the straightening vanes 63 may gradually increase toward the right, or may be at an even level.

The present disclosure is also applicable to an oil pan of a power unit such as an automatic transmission.

INDUSTRIAL APPLICABILITY

The present disclosure is useful for an oil pan which stores oil circulated in a power unit in an automobile, for example, and a separator for separating the inside of the oil pan.

What is claimed is:

1. An oil pan structure, comprising:

an oil pan body including a reservoir configured to store oil circulated in a power unit and returned to the reservoir; and a separator extending vertically and configured to partition the reservoir into a first reservoir and a second reservoir, such that oil always flows to the lowermost portion of the reservoir, wherein the separator includes an opening/closing means capable of establishing or cutting off communication between the first reservoir and the second reservoir, an oil passageway configured to allow oil to return from the power unit is provided above the first reservoir, when the first reservoir has a temperature lower than a given temperature, the opening/closing means cuts off communication between the first reservoir and the second reservoir such that oil in the power unit returns only to the first reservoir, when the first reservoir has a temperature equal to or higher than the given temperature, the opening/closing means establishes communication between the first reservoir and the second reservoir such that oil in the power unit returns to the second reservoir through the first reservoir, the first reservoir has a suction-member-placement region in which a member for sucking oil from the reservoir toward the power unit is provided at a bottom of the first reservoir, and the separator has an oil guide surface located at a surface toward the first reservoir and configured to have a top located below a downstream end of the oil passageway and a bottom located close to the suction-member placement region to allow oil dropping from the oil passageway to flow toward the suction-member placement region.

2. The oil pan structure of claim 1, wherein an oil receiver configured to receive oil below the downstream end of the oil passageway is provided on the oil guide surface, and the oil receiver is located on top of the oil guide surface.

3. The oil pan structure of claim 1 or 2, further comprising: wherein the oil guide surface has a communication portion configured to establish communication between the first reservoir and the second reservoir, and the opening/closing means is configured to open and close the communication portion.

4. The oil pan structure of claim 1 or 2, wherein a strainer configured to filter oil to be supplied to the power unit is provided in the first reservoir, the strainer includes a first strainer portion and a second strainer portion, and the first strainer portion is formed as one piece with the separator.

5. The oil pan structure of claim 4, wherein the separator includes a first separator portion and a second separator portion, the first strainer portion is formed as one piece with the first separator portion, and the second strainer portion is formed as one piece with the second separator portion.

6. The oil pan structure of claim 1 or 2, wherein a straightening means configured to straighten a flow of oil is formed in an oil guide part, and the straightening means projects upward from the oil guide part, and extends along the oil guide part.

7. The oil pan structure of claim 1 or 2, wherein the oil pan body includes a protrusion protruding toward the reservoir, the separator includes an interference prevention portion configured to prevent interference with the protrusion, and an oil guide surface is provided on a surface of the interference prevention portion toward the first reservoir.

8. A separator provided in an oil pan including a reservoir configured to store oil circulated in a power unit and returned to the reservoir, extending vertically, configured to partition the reservoir into a first reservoir and a second reservoir such that oil always flows to the lowermost portion of the reservoir, and including an opening/closing means capable of establishing or cutting off communication between the first reservoir and the second reservoir, wherein an oil passageway configured to allow oil to return from the power unit is provided above the first reservoir, the separator is configured to separate an inside of the oil pan in which when the first reservoir has a temperature lower than a given temperature the opening/closing means cuts off communication between the first reservoir and the second reservoir such that oil in the power unit returns only to the first reservoir, and when the first reservoir has a temperature equal to or higher than the given temperature, the opening/closing means establishes communication between the first reservoir and the second reservoir such that oil in the power unit returns to the second reservoir through the first reservoir, the first reservoir includes a suction-member-placement region in which a member for sucking oil from the reservoir toward the power unit is provided at a bottom of the first reservoir, and the separator has an oil guide surface located at a surface toward the first reservoir and configured to have a top located below a downstream end of the oil passageway and a bottom located close to the suction-member placement region to allow oil dropping from the oil passageway to flow toward the suction-member placement region.

* * * * *